US005999495A

United States Patent [19]

Hashizume et al.

[11] Patent Number: 5,999,495

[45] Date of Patent: Dec. 7, 1999

[54] TIMEPIECE MOVEMENT

[75] Inventors: Hiroyuki Hashizume; Koji Baba, both of Tokyo, Japan

[73] Assignee: Seiko Clock Inc., Japan

[21] Appl. No.: 08/964,588

[22] Filed: Nov. 5, 1997

[30] Foreign Application Priority Data

Nov. 6, 1996 [JP] Japan ..... 8-293929

[51] Int. Cl.[6] ..... G04B 19/04; G04B 19/02

[52] U.S. Cl. ..... 368/80; 368/220

[58] Field of Search ..... 368/46, 47, 69–74, 368/76, 80, 185–187, 220, 223, 250, 256

[56] References Cited

U.S. PATENT DOCUMENTS

| | | | |
|---|---|---|---|
| 4,253,173 | 2/1981 | Jaunin | 368/76 |
| 4,645,357 | 2/1987 | Allgaier et al. | 368/187 |
| 5,231,612 | 7/1993 | Allgaier et al. | 368/47 |
| 5,566,140 | 10/1996 | Kohata et al. | 368/220 |

FOREIGN PATENT DOCUMENTS

180880A2 5/1986 European Pat. Off. .

OTHER PUBLICATIONS

WPIL, Abstract Accession No. 90–068104/10 and DE 3828810 A, Kienzle et al., Mar. 1, 1990.

*Primary Examiner*—Vit Miska

*Attorney, Agent, or Firm*—Adams & Wilks

[57] ABSTRACT

A timepiece movement comprises a first luminous element for emitting light, a second luminous element for emitting light, and a light-receiving element for receiving the light emitted by the first and second luminous elements. A second wheel has an aperture through which light from the first luminous element may pass and a reflecting portion. A first transmitting wheel transmits a rotational drive to the second wheel as a function of second time and has an aperture through which light from the first luminous element may pass and which is positioned to become aligned with the aperture of the second wheel. A rotational minute wheel has apertures disposed at equal angular intervals and through which light from the second luminous element may pass. A rotational hour wheel has apertures through which light from the second luminous element may pass. Each of the apertures of the hour wheel are positioned to become aligned with respective ones of the apertures of the minute wheel during rotation of the minute and hour wheels. A second transmitting wheel transmits a rotational drive to the minute wheel and the hour wheel as a function of minute time and hour time, respectively. The second transmitting wheel has a plurality of apertures disposed at equal angular intervals and through which light from the second luminous element may pass. The apertures of the minute wheel are positioned to become aligned with respective ones of the apertures of the second transmitting wheel during rotation thereof.

17 Claims, 6 Drawing Sheets

TIMEPIECE MOVEMENT

BACKGROUND OF THE INVENTION

1. Field of the Invention

The present invention relates to a timepiece movement and, more particularly, to a timepiece movement in which a minute wheel and a second wheel are independently rotated and a standard position thereof can be detected.

2. Background Information

Conventionally, there is known a timepiece movement which is provided with a driving gear train for a second wheel and a driving gear train for a minute wheel having an aperture and a shading portion in a light path disposed between a light emitting diode and a light-receiving sensor opposite the light emitting diode. The timepiece movement automatically performs an initial position detection operation by driving the above gear trains in a state in which the light emitting diode is operated so as to detect a position in which an output of the light-receiving sensor is inverted from a level 0 to a level 1, and the determined position is set as an initial position of the second wheel, the minute wheel and an hour wheel.

In the foregoing conventional timepiece movement, a driving motor for driving the second wheel and a driving motor for driving the minute wheel and the hour wheel are provided, and a photo-diode or a photo-transistor is used as the light-receiving sensor. The driving motors for the second wheel and the hour and minute wheels are alternately rotated so that, at first, apertures of the second wheel and the hour and minute wheels coincide with each other so as to invert the output of the light-receiving sensor to the level 1, and thereafter the initial position detection operation is performed.

However, since there are a great number of combinations for which the aperture of the second wheel and the aperture of the hour and minute wheels coincide, there is a problem that a lot of time is necessary for bringing these apertures to coincide with each other. Further, the construction of the timepiece movement is such that most of the portions of the gears of the gear trains of the second wheel and the hour and minute wheels are defined by the apertures, thereby increasing a probability that infrared rays of the light emitting diode are transmitted therethrough. By this construction, the portions defined by the aperture hardly serve for detecting the position of the hour and minute wheels so that a time for detecting the position thereof increases. Further, since most of the portions of the gears are defined by the apertures, the strength thereof is greatly reduced.

SUMMARY OF THE INVENTION

In order to solve the foregoing problems associated with the conventional art, the present invention provides a timepiece movement which performs a position detecting operation for detecting a position of a second wheel by using only a reflection type photo-sensor having a luminous portion and a light-receiving portion and with no relation to a position of hour and minute wheels. Further, a position detecting operation for detecting a position of the hour and minute wheels is performed by using only the light-receiving portion of the reflection type photo-sensor and a separately provided luminous diode. Since the luminous diode is separately provided, an initial position detecting operation for detecting an initial position of the hour and minute wheels can be performed by relatively small apertures provided on the hour and minute wheels and by a number of pulses of a driving motor which provides rotation between adjacent apertures. Further, since the apertures provided on the hour and minute wheels are small, the strength of the wheels is not compromised.

The timepiece movement according to the present invention is structured such that a second wheel, which is rotated by a first driving motor through a first driving gear train, and a minute wheel, which is rotated by a second driving motor through a second driving gear train, are coaxially provided in such a manner as to be independently rotated in a case comprised of upper and lower cases. The second wheel is provided with an aperture, which can oppose and overlap an aperture formed on a first high speed transmitting wheel meshed with the second wheel, and a reflecting portion disposed at a predetermined angular interval to the aperture of the second wheel. A second high speed transmitting wheel is meshed with the minute wheel and is provided with a plurality of apertures at equal central angular intervals. The minute wheel is provided with a plurality of apertures at equal central angular intervals which can oppose and overlap the aperture of the second high speed transmitting wheel. An hour wheel is coaxial with the minute wheel and is provided with a plurality of apertures, which can oppose and overlap an aperture of the minute wheel, and a plurality of shading portions having different widths. A reflection type sensor comprising a first luminous element and a light-receiving element mounted on the upper case and a second luminous element mounted on the lower case are respectively provided on an outside portion of each of the first high speed transmitting wheel, the second wheel, the second high speed transmitting wheel, the minute wheel and the hour wheel in an opposite manner.

A program for performing an initializing operation for detecting an initial position of the second wheel and the hour and minute wheels is installed in a control circuit for controlling an operation of the first and second driving motors. The initializing operation is performed by driving the second wheel stepwise in a state in which the first luminous element is radiated so as to detect a position of the reflecting portion of the second wheel. When a position of the reflecting portion of the second wheel is detected, an output of the light-receiving element is inverted from a level 0 to a level 1, and the light-receiving element and the reflecting portion are opposed to and overlap each other. The second wheel is then further driven stepwise for a predetermined angular interval until the light-receiving element and the aperture of the second wheel are opposed to and overlap each other. The position in which the aperture of the second wheel is opposed to the light-receiving element is set as a standard position of the second wheel. The first luminous element is then turned OFF.

Thereafter, the minute wheel is driven stepwise in a state in which the second luminous element is radiated so as to detect a position in which the output of the light-receiving element is inverted from the level 0 to the level 1, and the detected position is set as a standard position of the hour and minute wheels. The second driving motor is then driven so as to invert the output of the light-receiving element to the level 0. Thereafter, a time corresponding to a counting number of a driving pulse of the second driving motor for a time that the output of the light-receiving element is inverted from the level 0 to the level 1 is determined by the relation between the time and the counting number stored in the control circuit and this inverted position is set as a standard position of the hour wheel.

Preferably, the angle between the aperture and the reflecting portion of the second wheel is 180 degrees.

DETAILED DESCRIPTION OF THE PREFERRED EMBODIMENT

A preferred embodiment of the present invention will now be described with reference to the accompanying drawings.

Figure 1:
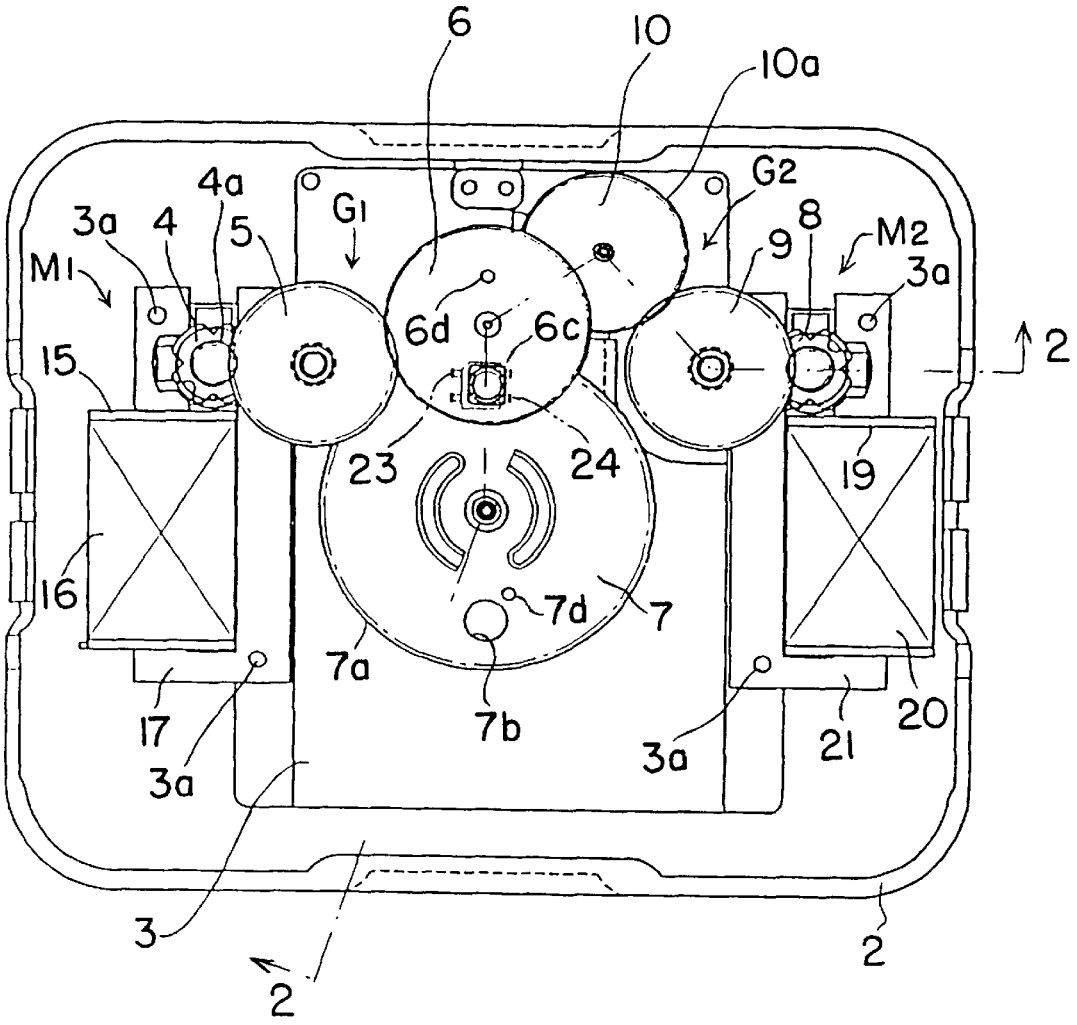
FIG. 1 is a plan view of a timepiece movement according to a preferred embodiment of the present invention with the printed circuit board and the upper case omitted.
Figure 2:
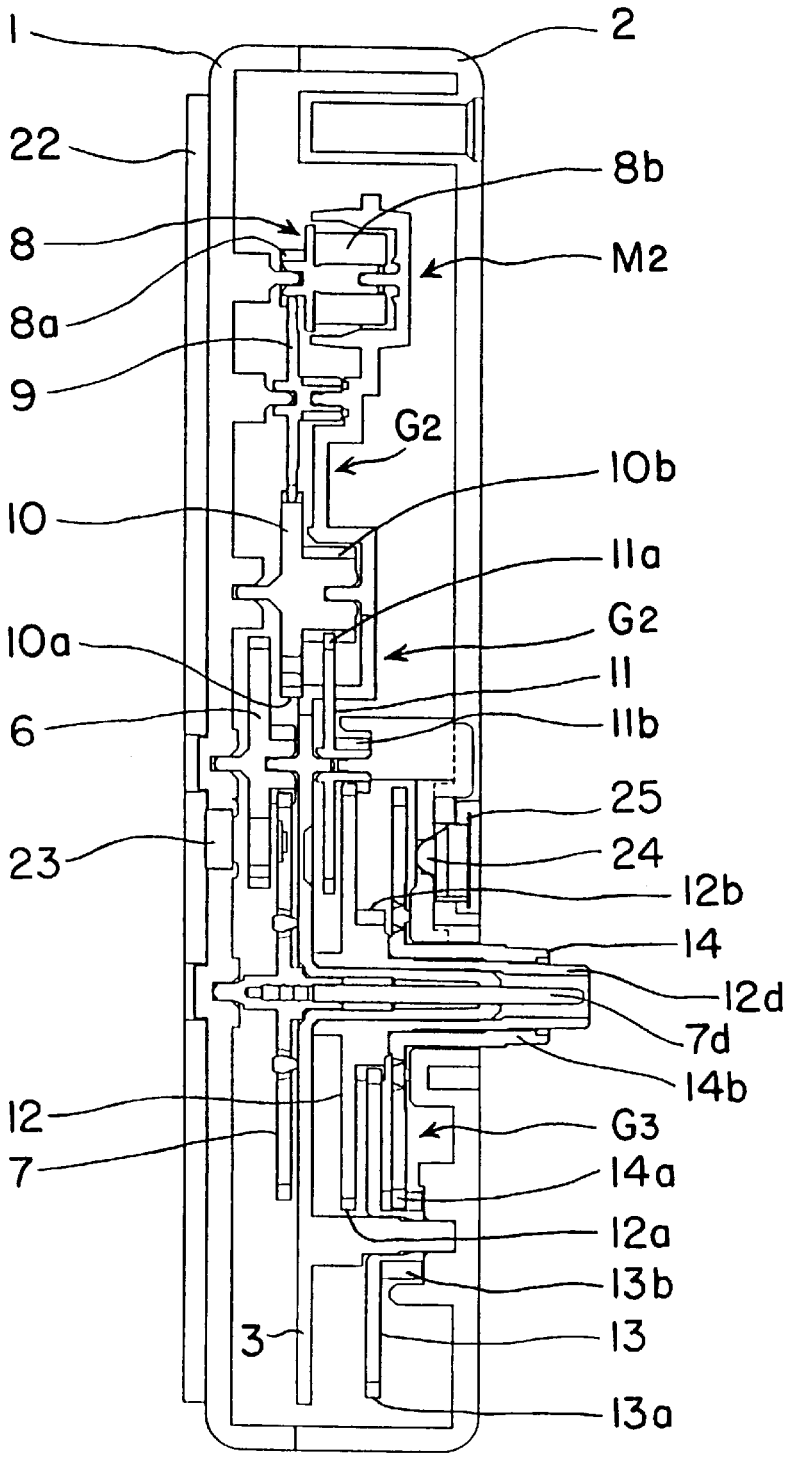
FIG. 2 is a cross-sectional view along line 2—2 in FIG. 1.
Figure 3:
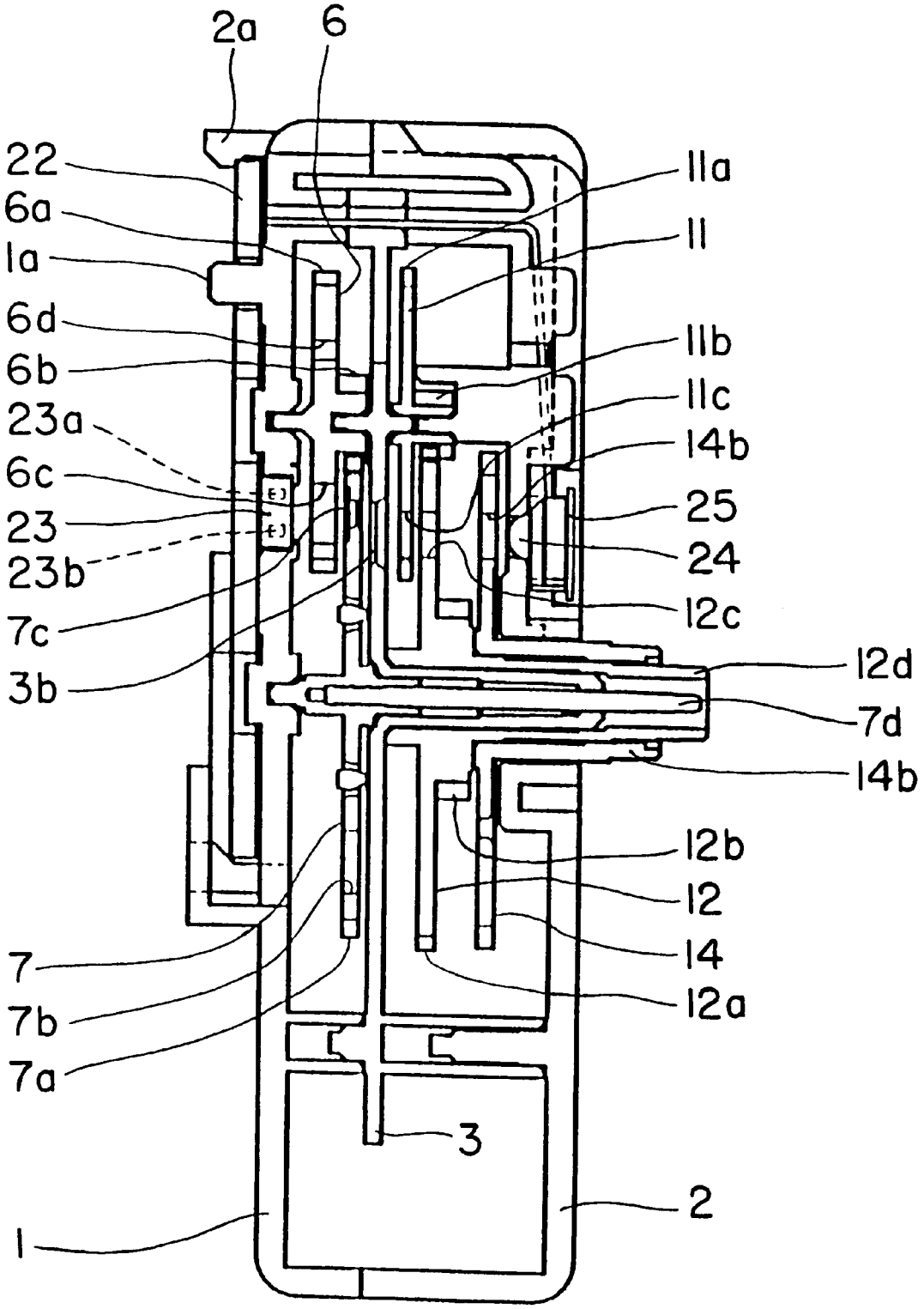
FIG. 3 is another cross-sectional view showing a state in which a reflecting portion of a second wheel is positioned at a position in which a light path of a reflection type sensor and a second light emitting diode is formed.

As shown in FIGS. 1 to 3, the timepiece movement has a case comprised of an upper case 1 and a lower case 2 connected in such a manner so as to oppose to each other, and a middle plate 3 disposed between the upper case and the lower case in parallel relation thereto. Two driving systems are mounted inside the case and include a first driving motor M1 and a second driving motor M2 controlled by a control circuit (not shown) so as to be independently operated. The rotations of the first driving motor M1 and the second driving motor M2 are transmitted by a first driving gear train G1 and a second driving gear train G2 to a second wheel 7 and a minute wheel 12, respectively. Rotation of the second driving motor M2 is also transmitted by a transmission gear train G3 to an hour wheel 14. A printed circuit board 22 is mounted in the case and supports the time movement circuitry.

The driving system for the second wheel 7 will now be described with reference to FIGS. 1–3. As shown in FIG. 1, the first driving motor M1 comprises a rotor 4, a coil frame 15, a coil 16 and a stator 17. The stator 17 is positioned and fixed in the case by a plurality of pins 3*a* extending through apertures formed in the stator 17, projecting toward the upper case 1 and connected to the middle plate 3. The rotor 4 is rotatably supported by the upper case 1 and the middle plate 3. A permanent magnet (not shown) is fixed to the rotor 4. The first driving gear train G1 includes a driving wheel 5 which meshes with a rotor pinion 4*a* of the rotor 4. A large diameter tooth portion or third gear 6*a* of a third wheel 6 meshes with the driving wheel 5. A large diameter tooth portion or second gear 7*a* of the second wheel 7 meshes with a small diameter tooth portion or third pinion 6*b*, coaxial with the third gear 6*a*, of the third wheel 6. The third wheel 6 defines a first transmitting wheel disposed at a higher speed side of the first driving gear train G1 than the second wheel 7.

By the foregoing construction, the rotation of the rotor 4 of the first driving motor M1 is transmitted to the second wheel 7 via the driving wheel 5 and the third wheel 6. As shown in FIGS. 2 and 3, a projecting portion 7*d* of the second wheel 7 projects through the lower case 2 to the outside, and a second hand (not shown) is mounted on the end of the projecting portion 7*d*. In this manner, the first driving motor M1 drives the second hand intermittently in a timed relation to indicate second time.

In a normal driven state, the rotor 4 for driving the second hand is rotated at a degree of half rotation at every one second by a driving pulse generated from the control circuit at every one second.

The second driving motor M2 comprises a rotor 8, a coil frame 19, a coil 20 and a stator 21. The stator 21 is positioned and fixed in the case by the plurality of pins 3*a* extending through apertures formed in the stator 21, projecting toward the upper case 1 and connected to the middle plate 3. The rotor 8 is rotatably supported by the upper case 1, the middle plate 3 and the lower case 2. A permanent magnet 8*b* is fixed to the rotor 8. The second driving gear train G2 includes a driving wheel 9 which meshes with a rotor pinion 8*a* of the rotor 8. A large diameter tooth portion or third gear 10*a* of a third wheel 10 meshes with the driving wheel 9. A large diameter tooth portion or fourth gear 11*a* of a fourth wheel 11 meshes with a small diameter tooth portion or third pinion 10*b*, coaxial with the third gear 10*a*, of the third wheel 10. A large diameter tooth portion or minute gear 12*a* of the minute wheel 12 meshes with a small diameter tooth portion or fourth pinion 11*b*, coaxial with the fourth gear 11*a*, of the fourth wheel 11. The fourth wheel 11 defines a second transmitting wheel disposed at a higher speed side of the second driving gear train G2 than the minute wheel 12.

The transmission gear train G3 includes a transmission wheel 13 having a large diameter tooth portion or transmission gear 13*a* meshing with a small diameter tooth portion or minute pinion 12*b*, coaxial with the minute gear 12*a*, of the minute wheel 12. A large diameter tooth portion or hour gear 14*a* of the hour wheel 14 meshes with a small diameter tooth portion or transmission pinion 13*b*, coaxial with the transmission gear 13*a*, of the transmission wheel 13.

By the foregoing construction, the rotation of the rotor 8 of the second driving motor M2 is transmitted to the minute wheel 12 via the driving wheel 9, the third wheel 10 and the fourth wheel 11, and to the hour wheel 14 via the minute wheel 12 and the transmission wheel 13. As shown in FIGS. 2 and 3, tubular portions 12*d* and 14*b* of the minute wheel 12 and the hour wheel 14, respectively, project through the lower case 2 to the outside, and a minute hand (not shown) and an hour hand (not shown) are respectively mounted on the projecting end of the tubular portions 12*d* and 14*b*. In this manner, the second driving motor M2 drives the minute hand and the hour hand intermittently in a timed relation to indicate minute time and hour time, respectively.

In a normal driven state, the rotor 8 for driving the minute hand is rotated at a degree of half rotation at every fifteen seconds by a driving pulse generated from the control circuit at every fifteen seconds. The second wheel 7 and the minute wheel 12 are coaxially provided in such a manner as to be independently rotated.

As shown in FIG. 3, the printed circuit board 22 is mounted on a guide pin 1*a* formed on an outer surface of the upper case 1, and an end portion is engaged by an engaging pawl 2*a* formed on the lower case 2. The control circuit (not shown) for controlling the operation of the first driving motor M1 and the second driving motor M2 to rotationally drive the second wheel 7, the minute wheel 12 and the hour wheel 14 is formed on the printed circuit board 22. A program which performs an initializing operation for detecting initial positions of the second wheel 7 and the minute and hour wheels 12, 14 is installed in the control circuit.

A reflection type sensor 23 (e.g., a reflection type photosensor) including a first luminous element (e.g., a light emitting diode) 23*a* having a light emitting function and a light receiving element (e.g., a photo-transistor) 23*b* having a light detecting function is mounted on the upper case 1. A second luminous element (e.g., a light emitting diode) 24 for emitting light to the reflection type sensor 23 is mounted on the lower case 2 in an opposing manner to the reflection type sensor 23. A pressing plate 25 comprised of a rectangular thin plate resilient member is provided on a rear surface of the second luminous element 24 for pressing the second luminous element 24 forward. Preferably, the pressing plate 25 is inserted into a thin groove (not shown) formed on the lower plate 2. The reflection type sensor 23 and the second luminous element 24 are both electrically connected to the printed circuit board 22 and various semiconductor elements which are not illustrated are connected to the printed circuit board 22 so as to form the control circuit. As described above, the control circuit controls the operation of the first and second driving motors M1 and M2, and a program for performing an initializing operation used for detecting an initial position of the second wheel 7 and the minute and hour wheels 12, 14 is installed in the printed circuit board 22. An aperture 3*b* which enables light from the second luminous element 24 to reach the reflection type sensor 23 is provided in the middle plate 3.

As described above, the timepiece movement of the present embodiment has two driving systems and in order to detect positions of the respective driving systems, two detecting systems are provided in the case.

At first, a position detecting system for driving the second hand will be explained below. The third wheel 6 for driving the second wheel 7 is provided with a small aperture 6*c* for detecting an initial position and an aperture 6*d* for determining the mutual relationship for assembling the gear train. The aperture 6*d* for determining the mutual relationship is an aperture smaller than the aperture 6*c* and is formed at a position of 180 degrees shifted and disposed closer to the rotating center of the third wheel 6 than the aperture 6*c*. The second wheel 7 is provided with a small aperture 7*b* for transmitting light and a reflecting portion 7*c* comprising a reflecting plate disposed at a predetermined angular interval to the aperture 7*b*. Preferably, the angle between the aperture 7*b* and the reflecting portion 7*c* of the second wheel is 180 degrees. The reflecting portion 7*c* is structured so as to reflect the light from the first luminous element 23*a* of the reflection type sensor 23.

The third wheel 6 is disposed between the reflection type sensor 23 and the second wheel 7 and structured such that when the aperture 7*b* or the reflecting portion 7*c* of the second wheel 7 is disposed in a position opposite to and overlaps the reflection type sensor 23, the aperture 6*c* for detecting the initial position is always positioned between the reflection type sensor 23 and the position opposing to the aperture 7*b* or the reflecting portion 7*c*. The second wheel 7 is provided with an aperture 7*d* for determining the mutual relationship for assembling the gear train. The aperture 7*d* for determining the mutual relationship is smaller than the aperture 7*b* and is formed at a position closer to the rotating center of the second wheel 7 than the aperture 7*b*.

Figure 4:
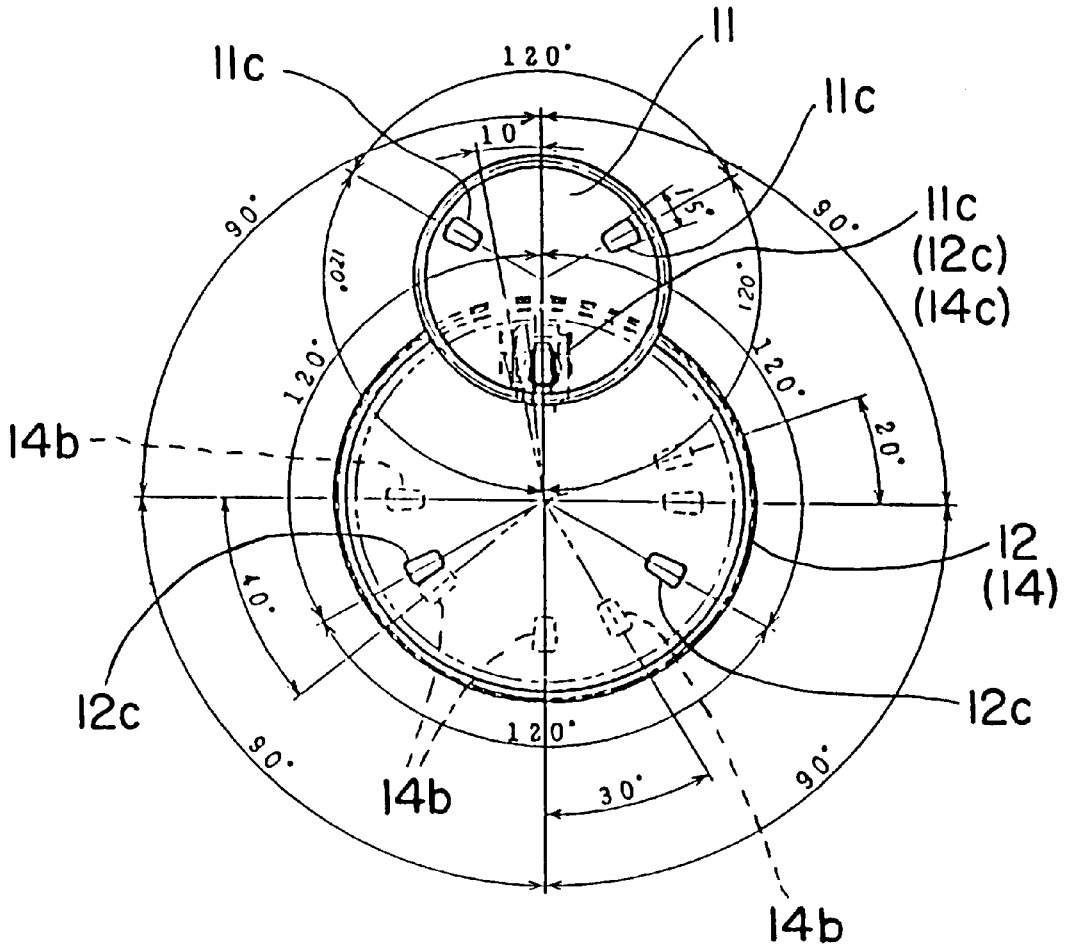
FIG. 4 is a plan view showing a state in which respective apertures of a fourth wheel for driving a minute hand, a minute wheel and an hour wheel are opposed to each other.
Figure 5:
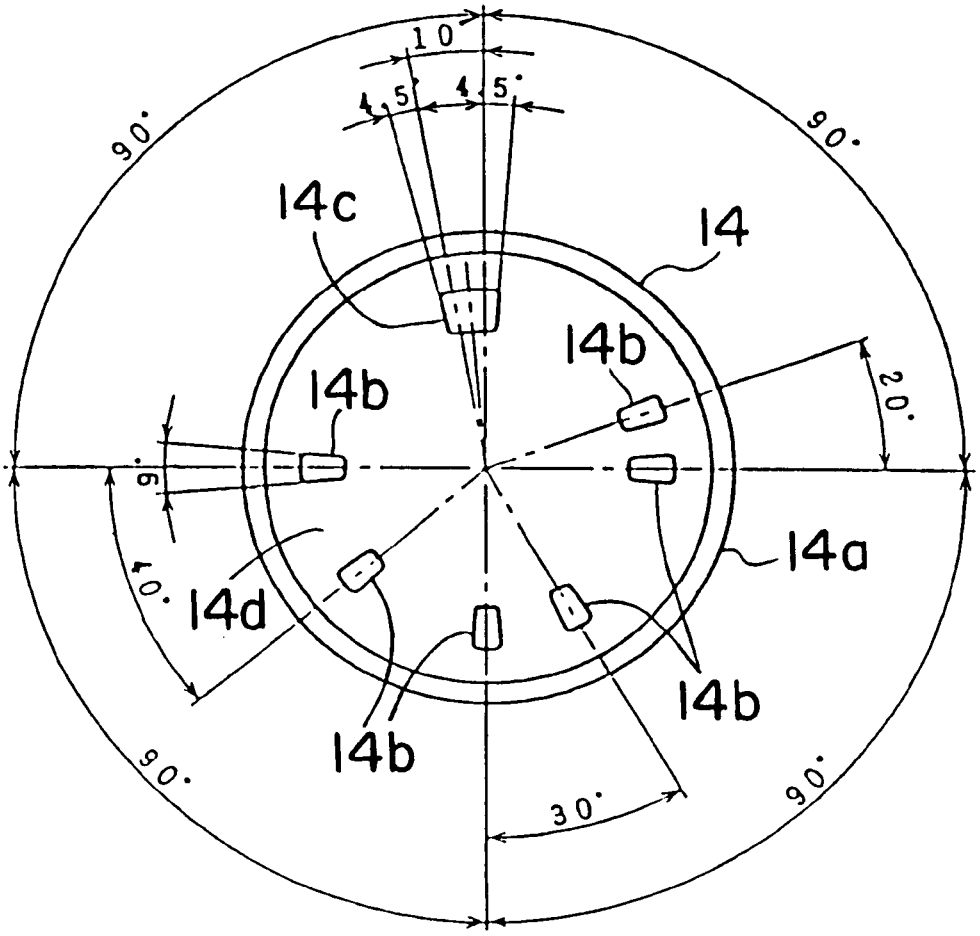
FIG. 5 is a plan view of the hour wheel.

The surface of the third wheel 6 is formed as a black surface which does not reflect light, and the surface of the second wheel 7, except the reflecting portion 7*c*, is also formed as a black surface which does not reflect the light. As shown in FIG. 4, the fourth wheel 11 is provided with three small apertures 11*c* each having the same shape and a central angle of 15 degrees. The small apertures 11*c* are formed on a concentric circle at 120 degrees interval, that is, at an equal central angular interval of 120 degrees. The minute wheel 12 is provided with three small apertures 12*c* each having the same shape and a central angle of 9 degrees. The small apertures 12*c* are formed at an equal central angular interval of 120 degrees. As shown in FIG. 5, the hour wheel 14 is provided with seven small apertures having the same shape and formed at a different central angular interval. More specifically, six small apertures 14*b* of the hour wheel have a central angle of 9 degrees and one small aperture 14*c* has a central angle of 19 degrees. A plurality of shading portions 14*d* having different widths are formed between the apertures 14*b*, 14*c*.

An aperture (not shown) for determining the mutual relationship for assembling the gear train is formed in each of the fourth wheel 11, the minute wheel 12 and the hour wheel 14. When the gear trains are assembled, the aperture 6*c* of the third wheel, the aperture 7*b* of the second wheel, the aperture 11*c* of the fourth wheel, the aperture 12*c* of the minute wheel and the aperture 14*b* of the hour wheel overlap each other on a straight light path of the reflection type sensor 23 and the second luminous element 24 by means of the aperture (not shown) of each of the fourth wheel 11, the minute wheel 12 and the hour wheel 14, the aperture 6*d* of the third wheel 6 and the aperture 7*d* of the second wheel 7.

Figure 6:
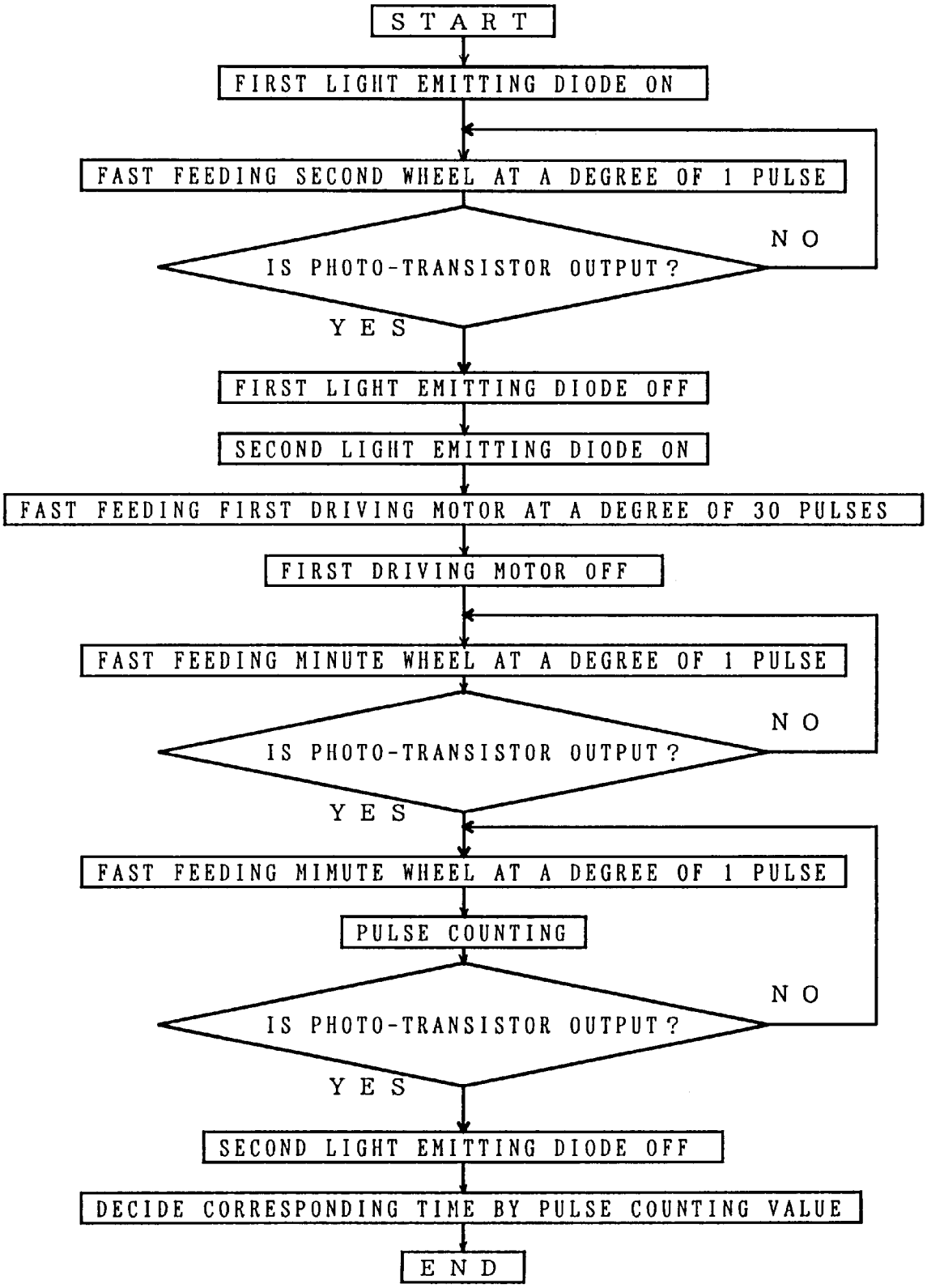
FIG. 6 is a flow chart for explaining an initial position detecting operation.

Operation of the position detecting system for driving the second wheel 7 and an operation of the position detecting system for driving the minute and hour wheels 12, 14 will next be explained with reference to FIG. 6. While light is being emitted from the first luminous element 23*a* of the reflection type sensor 23, the first driving motor M1 is rotated fast to drive the second wheel 7 stepwise so that the reflecting portion 7*c* of the second wheel 7 is opposed to and overlaps the reflection type sensor 23. The reflecting portion 7*c* reflects the light from the first luminous element 23*a*, and the reflected light reaches the light-receiving element 23*b* so as to detect the opposing position of the reflecting portion in which the output of the light-receiving element 23*b* is inverted from the level 0 to the level 1. When the output of the light-receiving element 23*b* is inverted from the level 0 to the level 1, the first luminous element 23*a* is turned OFF and light from the second luminous element 24 is emitted.

Next, the first driving motor M1 is again driven fast at a degree of 30 pulses from the reflecting portion opposing position and the second wheel 7 is driven stepwise to rotate 180 degrees so that the aperture 7*b* of the second wheel 7 is opposed to and overlaps the reflection type sensor 23, and this position of the second wheel 7 is set as a standard position of the second wheel 7. The first driving motor M1 is then stopped. Accordingly, the position in which the aperture 7*b* of the second wheel 7 is opposed to and overlaps the reflection type sensor 23 becomes the standard position of the second wheel 7, whereby the position detection of the second hand is completed. In this state, the aperture 6*c* of the third wheel 6 and the aperture 7*b* of the second wheel 7 are opposed to and overlap each other on the straight light path of the reflection type sensor 23 and the second luminous element 24 so that the first driving gear train G1 does not shade or block the light emission of the second luminous element 24.

Next, the position detection operation of the hour and minute hands will be described. While light is being emitted from the second luminous element 24, the second driving motor M2 is rotated fast to drive the minute wheel 12 stepwise. In a short time, the second luminous element 24, the aperture 14*b* of the hour wheel 14, the aperture 12*c* of the minute wheel 12, the aperture 11*c* of the fourth wheel 11 and the reflection type sensor 23 are opposed to and overlap each other and the light from the second luminous element 24 reaches the light-receiving element 23*b*, thereby detecting the position in which the output of the light-receiving element 23*b* is inverted from the level 0 to the level 1. The detected position is set as the standard position of the minute and hour wheels 12, 14. Thereafter, by driving the second driving motor M2 from the standard position, the output of the light-receiving element 23*b* is inverted to the level 0, and by determining the time corresponding to the counting number of driving pulses of the second driving motor M2 until the output of the light-receiving element 23*b* is further inverted from the level 0 to the level 1 on the basis of times previously stored in the control circuit, the inverted position is set to the standard position of the hour wheel. Accordingly, when the second driving motor M2 is driven from the standard position of the minute and hour wheels 12, 14, the fourth wheel 11 is rotated at an angle of 15 degrees by a first pulse so as to invert the output of the light-receiving element to the level 0.

The fourth wheel 11 is structured such that the minute wheel 12 rotates at an angle of 10.5 degrees, which is not less than the angle of 9 degrees of the aperture 12*c* of the minute wheel, by 7 pulses, while the next aperture 11*c* of the fourth wheel comes to the position opposing to and overlapping the second light emitting diode 24 by 8 pulses, the output of the light-receiving element 23*b* is inverted to the level 0, and the counting number of driving pulses of the second driving motor M2 until the output of the light-receiving element 23*b* is inverted from the level 0 to the level 1 is set to an integral number of times of 80.

In the present embodiment, the timing of the level 1 is set to twelve o'clock, twenty past two o'clock, three o'clock, five o'clock, six o'clock, forty past seven o'clock, nine o'clock and forty past eleven o'clock. In order to show what time the level 1 corresponds to, the time is set such that twelve o'clock is applied in the case that the number of driving pulses from the level 0 to the level 1 is 80, twenty past two o'clock is applied in the case of 560 pulses, three o'clock is applied in the case of 160 pulses, five o'clock is applied in the case of 480 pulses, six o'clock is applied in the case of 240 pulses, forty past seven o'clock is applied in the case of 400 pulses, nine o'clock is applied in the case of 320 pulses and forty past eleven o'clock is applied in the case of 640 pulses. When the time corresponding to the number of the driving pulses from the level 0 to the level 1 is determined, the second luminous element 24 is turned OFF. Accordingly, after completing the initial position detection, the initial position detecting time is automatically corrected to the present time provided by a standard frequency second time signal outputted by the control circuit and then used.

In the present embodiment, at a time of detecting the standard position of the second wheel, the first luminous element 23*a* is turned OFF when the output of the light-receiving element 23*b* is inverted from the level 0 to the level 1. However, the invention is not limited to this structure, and the time when the first luminous element 23*a* is turned OFF can be set to any time before the minute wheel is driven stepwise at a time of operating the position detecting system for driving the hour and minute hands.

By the foregoing construction, since the timepiece movement in accordance with the present invention uses a reflection type photo-sensor and the driving gear train for driving the second hand is independently provided as a single detecting system, the detecting operation can be performed by only the driving gear train for driving the second hand so that the initial position detecting operation can be quickly performed. Since the detection of the hour and minute hands can be performed by detecting the number of pulses between the apertures so that the determination of the time can be performed without rotating the hour wheel at a rotation, the initial position detecting operation can be quickly performed. Since the detection of the hour and minute hands are performed by the small apertures, the strength of the gears can be increased.

Moreover, since the angle between the aperture and the reflecting portion of the second wheel is 180 degrees, the aperture and the reflecting portion can be easily set.

From the foregoing description, it can be seen that the present invention comprises an improved timepiece movement. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

We claim:

1. A timepiece movement comprising: a second wheel; a first gear train; first drive means for rotationally driving the first gear train to rotate the second wheel as a function of second time; a minute wheel; an hour wheel; a second gear train; second drive means operable independently of the first drive means for rotationally driving the second gear train to rotate the minute wheel and the hour wheel as a function of minute time and hour time, respectively; and detecting means for detecting respective standard positions of the second wheel and the minute and hour wheels; wherein the first gear train comprises a first transmitting wheel for transmitting the rotational drive of the first drive means to the second wheel, and the second gear train comprises a second transmitting wheel for transmitting the rotational drive of the second drive means to the minute wheel; and wherein the detecting means comprises a first luminous element for emitting light, a second luminous element for emitting light, a light-receiving element for receiving the light emitted by the first and second luminous elements, an aperture formed in the second wheel through which light from the first luminous element passes, a reflecting portion provided on the second wheel, an aperture formed in the first transmitting wheel through which light from the first luminous element passes and positioned to become aligned with the aperture of the second wheel, a plurality of apertures formed in the second transmitting wheel at equal angular intervals through which light from the second luminous element passes, a plurality of apertures formed in the minute wheel at equal angular intervals through which light from the second luminous element passes and each positioned to become aligned with one of the apertures of the second transmitting wheel, and a plurality of apertures formed in the hour wheel through which light from the second luminous element passes and each positioned to become aligned with one of the apertures of the minute wheel.

2. A timepiece movement as claimed in claim 1; wherein the first transmitting wheel is disposed at a higher speed side of the first gear train than the second wheel; and wherein the second transmitting wheel is disposed at a higher speed side of the second gear train than the minute wheel.

3. A timepiece movement as claimed in claim 1; further comprising a case having upper and lower cases; and wherein the second wheel, the minute wheel and the hour wheel are supported by the upper and lower cases in coaxial relationship with one another.

4. A timepiece movement as claimed in claim 1; wherein the plurality of apertures of the hour wheel are separated by a plurality of shading portions for preventing light from the first luminous element to pass therethrough to the light-receiving element, each of the shading portions having a width different than a width of the other shading portions.

5. A timepiece movement as claimed in claim 1; wherein the aperture and the reflecting portion of the second wheel are disposed at an angle of 180 degrees.

6. A timepiece movement as claimed in claim 1; further comprising control means for controlling operation of the first drive means and the second drive means to rotationally drive the second wheel, the minute wheel and the hour wheel.

7. A timepiece movement as claimed in claim 6; wherein the control means includes initializing means for performing an initializing operation for detecting an initial position of the second wheel, the minute wheel and the hour wheel.

8. A timepiece movement as claimed in claim 7; wherein the initializing means includes means for performing an initializing operation by driving the second wheel by the first drive means in a stepwise manner while the first luminous element emits light, detecting a position of the reflecting portion of the second wheel in which an output of the light-receiving element is inverted from a level 0 to a level 1 and the light-receiving element is opposed to and overlaps the reflecting portion, driving the second wheel by the first drive means for a predetermined angular interval from the detected position to a predetermined position in which the aperture of the second wheel is opposed to and overlaps the light-receiving element, setting the predetermined position of the second wheel as a standard position, stopping the first luminous element from emitting light, driving the minute wheel by the second drive means in a stepwise manner while the second luminous element emits light to detect a position of the minute wheel and the hour wheel in which the output of the light-receiving element is inverted from the level 0 to the level 1, setting the detected position as a standard position of the minute wheel and the hour wheel, driving the second drive means to invert the output of the light-receiving element to the level 0, determining a time corresponding to the number of pulses of the second driving means for inverting the output of the light-receiving element from the level 0 to the level 1, and setting a position of the hour wheel corresponding to the level 1 of the light-receiving element to a standard position of the hour wheel.

9. A timepiece movement as claimed in claim 8; wherein the angle between the aperture and the reflecting portion of the second wheel is 180 degrees.

10. A timepiece movement comprising: a first luminous element for emitting light; a second luminous element for emitting light; a light-receiving element for receiving the light emitted by the first and second luminous elements; a second wheel having an aperture through which light from the first luminous element may pass and a reflecting portion; a first gear train having a first transmitting wheel for transmitting a rotation al drive to the second wheel as a function of second time, the first transmitting wheel having an aperture through which light from the first luminous element may pass and being positioned to become aligned with the aperture of the second wheel; a rotational minute wheel having a plurality of apertures disposed at equal angular intervals and through which light from the second luminous element may pass; a rotational hour wheel having a plurality of apertures through which light from the second luminous element may pass, each of the apertures of the hour wheel being positioned to become aligned with respective ones of the apertures of the minute wheel during rotation of the minute and hour wheels; and a second gear train having a second transmitting wheel for transmitting a rotational drive to the minute wheel and the hour wheel as a function of minute time and hour time, respectively, the second transmitting wheel having a plurality of apertures disposed at equal angular intervals and through which light from the second luminous element may pass, the apertures of the minute wheel being positioned to become aligned with respective ones of the apertures of the second transmitting wheel during rotation of the minute and second transmitting wheels.

11. A timepiece movement as claimed in claim 10; wherein the first transmitting wheel is disposed at a higher speed side of the first gear train than the second wheel; and wherein the second transmitting wheel is disposed at a higher speed side of the second gear train than the minute wheel.

12. A timepiece movement as claimed in claim 10; wherein the plurality of apertures of the hour wheel are separated by a plurality of shading portions for preventing light from the first luminous element to pass therethrough to the light-receiving element, each of the shading portions having a width different than a width of the other shading portions.

13. A timepiece movement as claimed in claim 10; wherein the aperture and the reflecting portion of the second wheel are disposed at an angle of 180 degrees.

14. A timepiece movement as claimed in claim 10; further comprising control means for controlling operation of the first transmitting wheel and the second transmitting wheel to rotationally drive the second wheel, the minute wheel and the hour wheel.

15. A timepiece movement as claimed in claim 14; wherein the control means includes initializing means for performing an initializing operation for detecting an initial position of the second wheel, the minute wheel and the hour wheel.

16. A timepiece movement as claimed in claim 15; wherein the initializing means includes means for performing an initializing operation for driving the second wheel by first transmitting wheel in a stepwise manner while the first luminous element emits light, detecting a position of the reflecting portion of the second wheel in which an output of the light-receiving element is inverted from a level 0 to a level 1 and the light-receiving element is opposed to and overlaps the reflecting portion, driving the second wheel by the first transmitting wheel for a predetermined angular interval from the detected position to a predetermined position in which the aperture of the second wheel is opposed to and overlaps the light-receiving element, setting the predetermined position of the second wheel as a standard position, stopping the first luminous element from emitting light, driving the minute wheel by the second transmitting wheel in a stepwise manner while the second luminous element emits light to detect a position of the minute wheel and the hour wheel in which the output of the light-receiving element is inverted from the level 0 to the level 1, setting the detected position as a standard position of the minute wheel and the hour wheel, driving the second transmitting wheel to invert the output of the light-receiving element to the level 0, determining a time corresponding to the number of pulses of the second driving means for inverting the output of the light-receiving element from the level 0 to the level 1, and setting a position of the hour wheel corresponding to the level 1 of the light-receiving element to a standard position of the hour wheel.

17. A timepiece movement as claimed in claim 16; wherein the angle between the aperture and the reflecting portion of the second wheel is 180 degrees.

* * * * *